US007864963B2

(12) United States Patent
Hagiwara

(10) Patent No.: US 7,864,963 B2
(45) Date of Patent: Jan. 4, 2011

(54) EFFECT IMPARTING APPARATUS FOR CONTROLLING TWO-DIMENSIONAL SOUND IMAGE LOCALIZATION

(75) Inventor: Hideki Hagiwara, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 358 days.

(21) Appl. No.: 10/385,933

(22) Filed: Mar. 11, 2003

(65) Prior Publication Data

US 2003/0174845 A1 Sep. 18, 2003

(30) Foreign Application Priority Data

Mar. 18, 2002 (JP) ..... 2002-074150

(51) Int. Cl.
*H04R 5/00* (2006.01)
*H04R 5/02* (2006.01)

(52) U.S. Cl. ..... 381/19; 381/17; 381/18; 381/307

(58) Field of Classification Search ..... 381/17, 381/18, 19, 309, 310, 306, 307, 124
See application file for complete search history.

(56) References Cited

U.S. PATENT DOCUMENTS 3,969,588 A * 7/1976 Raydon et al. ..... 381/307
5,459,790 A * 10/1995 Scofield et al. ..... 381/310
5,602,358 A 2/1997 Yamamoto
5,715,318 A 2/1998 Hill et al.
5,796,845 A 8/1998 Serikawa et al.
5,799,094 A 8/1998 Mouri
5,822,438 A 10/1998 Sekine et al.
5,844,993 A 12/1998 Ilda et al.
5,946,400 A 8/1999 Matsuo
6,016,473 A 1/2000 Dolby
6,072,878 A 6/2000 Moorer
6,459,797 B1 * 10/2002 Ashour et al. ..... 381/18

FOREIGN PATENT DOCUMENTS

JP 10-257597 9/1998
JP 11-046400 2/1999
JP 11-69500 3/1999
JP 2003-531555 10/2003

OTHER PUBLICATIONS

European Search Report mailed Feb. 27, 2009 for Application No. 03005113.0/1347668.

* cited by examiner

*Primary Examiner*—Vivian Chin
*Assistant Examiner*—Douglas J Suthers
(74) *Attorney, Agent, or Firm*—Morrison & Foerster LLP

(57) ABSTRACT

Multi-channel audio signals arranged to achieve original two-dimensional sound image localization are input, and the audio signal of each channel, included in the input multi-channel audio signals, is distributed to individual output channels. Each of the distributed signals is multiplied by a corresponding coefficient determined independently for each of the output channels, in accordance with a deviation from the original two-dimensional sound image localization. Then, the audio signals distributed to the individual output channels and multiplied by the corresponding coefficients are summed up, separately for each of the output channels. Thus, the summed-up audio signals of the individual output channels are output as multi-channel audio signals having the sound image localization varied in accordance with the deviation. If the deviation from the original two-dimensional sound image localization is varied over time, a panning effect can be achieved.

36 Claims, 8 Drawing Sheets

| OUTPUT / INPUT | OUT3' (LS) 150° | OUT1' (L) 60° | OUT5' (C) 0° | OUT2' (R) -60° | OUT4' (LS) -150° |
|---|---|---|---|---|---|
| IN3" (LS) -150° | C33 LFO1 0° | C31 LFO8 270° | C35 LFO6 210° | C32 LFO5 150° | C34 LFO2 60° |
| IN1" (L) -60° | C13 LFO3 90° | C11 LFO1 0° | C15 LFO9 300° | C12 LFO7 240° | C14 LFO5 150° |
| IN5" (C) 0° | C53 LFO5 150° | C51 LFO2 60° | C55 LFO1 0° | C52 LFO9 300° | C54 LFO6 210° |
| IN2" (R) 60° | C23 LFO6 210° | C21 LFO4 120° | C25 LFO2 60° | C22 LFO1 0° | C24 LFO8 270° |
| IN4" (RS) 150° | C43 LFO9 300° | C41 LFO6 210° | C45 LFO5 150° | C42 LFO3 90° | C44 LFO1 0° |

EFFECT IMPARTING APPARATUS FOR CONTROLLING TWO-DIMENSIONAL SOUND IMAGE LOCALIZATION

BACKGROUND OF THE INVENTION

The present invention relates to an effect imparting apparatus for changing or controlling sound image localization states of multi-channel audio signals arranged to achieve sound image localization in two dimensions (in a two-dimensional plane).

In the field of tone generators and mixers, one-dimensional sound-image-localizing panning control has been conventionally performed to control sound volume balance between left (L) and right (R) channels in accordance with operated amounts of predetermined panning operators. It has also been conventionally known to perform automatic panning control which automatically pans (i.e., moves) sound image localization (here, sound-image-localized position or sound image position) of left and right channels by controlling sound volume balance between left and right channels in accordance with a low-frequency waveform generated by a low-frequency oscillator (LFO) rather than in accordance with user's operation of predetermined panning operators. Further, a 5.1-channel surround mode is often employed these days, and it has also been proposed to perform multi-channel panning (see Japanese Patent Laid-open Publication No. HEI-11-46400). For example, to perform panning for 5.1 channels, coordinates in a two-dimensional plane are designated, for each input channel, in response to user operation of respective operators so that sound volume balance among audio signals to be output from the input channel to five mixing buses (i.e., left (L), right (R), center (C), left rear (LS) and right rear (RS)) is controlled in accordance with the designated 5.1-channel coordinates. However, the conventional 5.1-channel sound image panning control is extremely complicated and troublesome because the panning control is performed in a signal source that generates multi-channel audio signals.

Today, with widespread use of DVDs (Digital Versatile Disks), it has become common to handle multi-channel audio signals of the 5.1-channel surround mode. Such surround-mode multi-channel audio signals are imparted in advance with given two-dimensional sound image localization. However, hitherto, there has been no effect imparting apparatus which can input thereto multi-channel audio signals, such as those of the 5.-1 channel surround mode, and easily impart the input audio signals with an effect to pan or change the original two-dimensional sound image localization of the audio signals.

SUMMARY OF THE INVENTION

In view of the foregoing, it is an object of the present invention to provide an effect imparting apparatus which can input thereto multi-channel audio signals, such as those of the 5.-1 channel surround mode, and impart a sound-image-localization controlling effect to the input audio signals.

To accomplish the above-mentioned object, the present invention provides an effect imparting apparatus which inputs thereto multi-channel audio signals arranged to achieve original two-dimensional sound image localization and then imparts the multi-channel audio signals with an effect to vary the original two-dimensional sound image localization, and which comprises: a multiplication section that distributes the audio signal of each channel, included in the input multi-channel audio signals, to individual ones of a plurality of output channels and multiplies each of the distributed audio signals by a corresponding coefficient determined independently for each of the output channels in accordance with a deviation from the original two-dimensional sound image localization; and an addition section that is provided in corresponding relation to the output channels and sums up the audio signals, distributed to the individual output channels and multiplied by the corresponding coefficients, separately for each of the output channels. Thus, the summed-up audio signals of the output channels are output from the apparatus as multi-channel audio signals imparted with varied sound image localization corresponding to the deviation.

With the above inventive arrangements, there can be provided a simplified effect imparting apparatus which can readily variably control original two-dimensional sound image localization of input multi-channel audio signals of the 5.1-channel surround mode. If the deviation from the original two-dimensional sound image localization is varied over time, the effect imparting apparatus of the invention achieves a panning effect to cause the original sound-image-localized position to be panned (moved) in two dimensions (in a two-dimensional plane). Thus, use of the effect imparting apparatus of the present invention allows a user to enjoy freely panning-control and thereby varying an existing two-dimensional sound image localization state of a source of multi-channel audio signals, such as DVD software.

According to an embodiment of the present invention, the effect imparting apparatus of the present invention can change the localization direction while keeping relative localization states of the input multi-channel audio signals originally localized in two dimensions. Further, by setting the coefficients as a time-varying function, it is possible to produce a sound image that rotates (i.e., move generally circularly) in a two-dimensional plane within a virtual sound field. Further, by setting the time-varying function to vary in a sine waveform, the present invention can rotate the localization direction while maintaining sound volume perceived by the human auditory sense, and by making the time-varying function a sine wave function, it can also rotate the localization (sound-image-localized position) in response to such LFO signals as conventionally used in an effecter. Further, by making the sine wave a half-wave-rectified function, it is possible to improve a feeling of localization of the multi-channel audio signals having been subjected to the rotation of the sound-image-localized position, even where the localization is rotated in response to an LFO signal. Furthermore, by varying the deviation with control data generated in response to user operation of a predetermined operator, the present invention can freely rotate the localization (sound-image-localized position) of the multi-channel audio signals. Moreover, by varying the control data at a speed or rate corresponding to speed data, the present invention can rotate the sound-image-localized position of the multi-channel audio signals in accordance with the speed designated by the speed data.

According to another aspect of the present invention, there is provided an effect imparting apparatus which controls sound image localization of multi-channel audio signals, and which comprises: a multiplication section that distributes the audio signal of each channel, included in input multi-channel audio signals, to individual ones of a plurality of sound-image localizing channels and multiplies each of the distributed audio signals by a corresponding sound-image localizing coefficient determined independently for each of the sound-image localizing channels; an addition section that is provided in corresponding relation to the sound-image localizing channels and sums up the audio signals, distributed to the individual sound-image localizing channels and multiplied by the corresponding coefficients, separately for each of the sound-image localizing channels, the summed-up audio signals of the individual sound-image localizing channels being outputted as multi-channel audio signals having controlled sound image localization; and a coefficient generation section that generates the sound-image localizing coefficients, using governing functions for respective localized positions of the plurality of sound-image localizing channels.

In the present invention, the multi-channel audio signals input to the effect imparting apparatus may be either analog audio signals or digital analog signals. In the case where the multi-channel audio signals are digital audio signals, multipliers and adders employed in the effect imparting apparatus are implemented by a digital arithmetic operation device. The digital arithmetic operation device may be implemented either by dedicated hardware circuitry or by a combination of a processor, such as a CPU or DSP, and software operating the processor.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE EMBODIMENT

Figure 1:
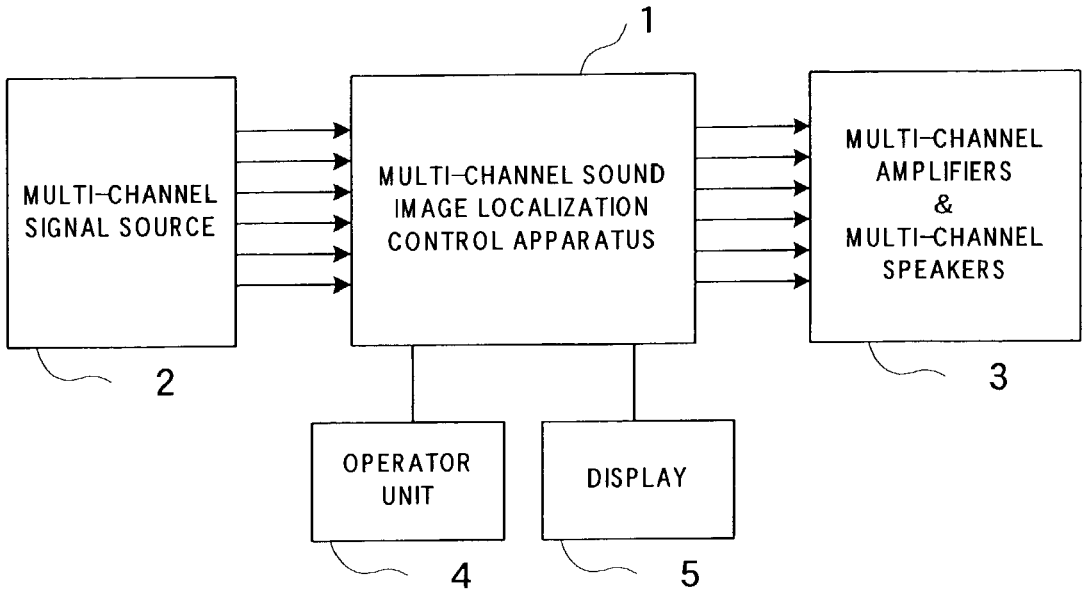
FIG. 1 is a block diagram showing a general setup of an audio apparatus including an effect imparting apparatus of the present invention.

FIG. 1 shows an audio apparatus that includes an effect imparting apparatus of the present invention constructed as a multi-channel sound image localization control apparatus 1, to which are input, from a multi-channel signal source 2, multi-channel audio signals of, for example, the 5.1-channel surround mode. As well known in the art, such multi-channel audio signals of the 5.1-channel surround mode are previously set, in the signal source, to such sound volumes as to achieve given two-dimensional sound image localization (i.e., original two-dimensional sound image localization). The multi-channel signal source 2 may be any of a DVD, mixer, tone generator, HDR etc. that support the 5.1-channel surround mode. As will be later described, the multi-channel sound image localization control apparatus 1 imparts the input multi-channel audio signals of the 5.1-channel surround mode with a two-dimensional panning effect to rotate the sound image localization (here, sound-image-localized position) of the audio signals while keeping their relative localization states, and then supplies the thus panning-effect-imparted audio signals to multi-channel speakers 3 having multi-channel amplifiers incorporated therein. In this way, it is possible to obtain a 5.1-channel sound image that is panned (moved) in two dimensions from the multi-channel speakers 3 with the multi-channel amplifiers incorporated therein. In this case, by operating a predetermined operator of an operator unit 4 with a localization control screen displayed on a display device 5 that is in the form of an LCD (Liquid Crystal display) or the like, sound image localization to be imparted to the audio signals can be controlled in accordance with the operation of the operator.

As known, the 5.1-channel surround mode is a mode where left, center and right front speakers L, C, R are placed in front of a listener (virtual listening position) and left and right rear speakers LS, RS are placed at the rear of the listener, with a woofer speaker LFE placed at a suitable position, to achieve a sense of presence or realism. Further, multi-channel mode audio signals of the 5.1-channel surround mode comprise audio signals of five channels L, C, R, LS, RS localized in two dimensions in correspondence with the left, center and right front speakers L, C, R and left and right rear speakers LS, RS, and a non-localized audio signal of the woofer or LFE (Low Frequency Effect) channel. The reason why the LFE-channel audio signal is not subjected to localization is that the LFE-channel audio signal is a low-pitched sound signal that can not be clearly localized.

Figure 2:
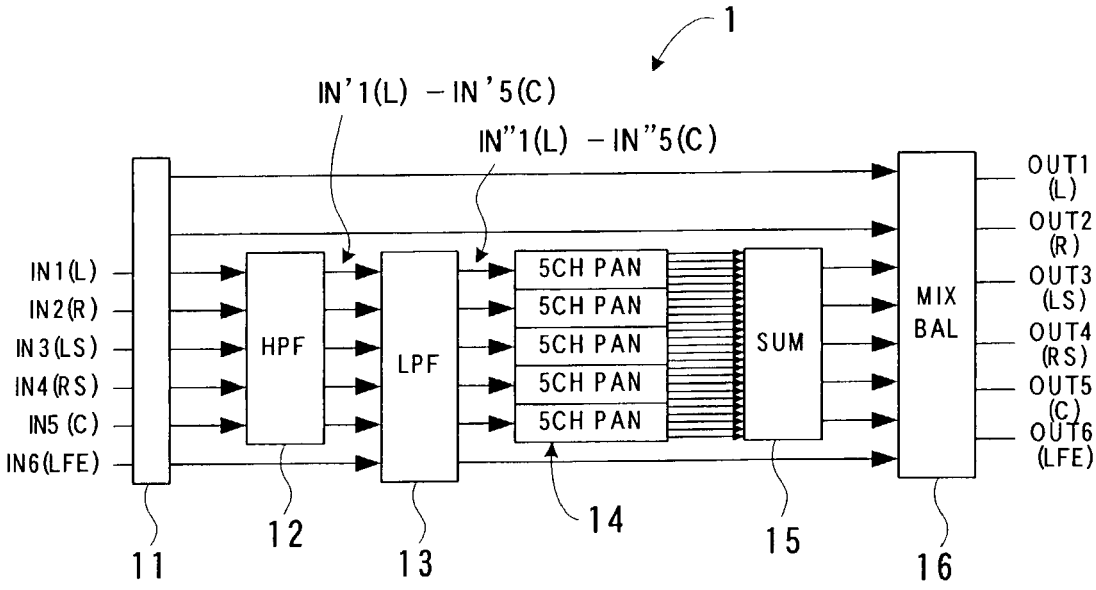
FIG. 2 is a block diagram showing a general setup of a multi-channel sound image localization control apparatus in accordance with an embodiment of the present invention.

FIG. 2 is a block diagram showing a general setup of the multi-channel sound image localization control apparatus 1 of FIG. 1. Where the multi-channel sound image localization control apparatus 1 is designed for the 5.1-channel surround mode, it includes six inputs IN1-IN6 and six outputs OUT1-OUT 6 corresponding to the 5.1 channels. Namely, the input IN1 and output OUT1 are for the L-channel signals, the input IN2 and output OUT2 are for the R-channel signals, the input IN3 and output OUT3 are for the LS-channel signals, the input IN4 and output OUT4 are for the RS-channel signals, and the input IN5 output OUT5 are for the C-channel signals, and the input IN6 and output OUT6 are for the LFE-channel signals. The input audio signals (hereinafter denoted by IN1-IN6) of the above-mentioned channels are distributed via a distributor 11 to respective signal paths, of which the signals IN1(L)-IN5(C) of the five channels (L, R, LS, RS, C) are delivered to a high-pass filter (HPF) 12 for removal therefrom of unnecessary low-frequency components. The cutoff frequency of the HPF 12 is adjustable via the operator unit 4. Signals IN'1(L)-IN'5(C) of the five channels output from the HPF 12 and input signal IN6 of the remaining LFE channel are fed to an low-pass filter (LPF) 13 for removal therefrom of unnecessary high-frequency components. The cutoff frequency of the HPF 13 is also adjustable via the operator unit 4.

Signals IN"1(L)-IN"5(C) of the five channels output from the LPF 13 are given to a 5-channel panning control section 14, which converts the signals IN"1(L)-IN"5(C) to accomplish a panning effect such that overall sound image localization is varied or rotated with relative localization states of the five-channel signals still kept as original. Five-channel outputs are produced from each of the panning control elements of the 5-channel panning control section 14, and the outputs of the corresponding channels are collected and then summed up and synthesized on a channel-by-channel basis by a synthesis (SUM) section 15. In this way, there can be generated audio signals of the five channels L, R, LS, RS, C having been subjected to sound image localization control to achieve a moving sound image. The five-channel signals output from the synthesis (SUM) section 15 are supplied to a mixer (MIX-BAL) 16, along with the other signals distributed via the distributor 11 and transferred over the other signal paths. Then, the 5.1-channel audio signals, having been mixed and adjusted in level via the mixer 16, are provided from the mixer 16 as output signals (denoted by OUT1(L)-OUT6(LFE)).

Figure 3:
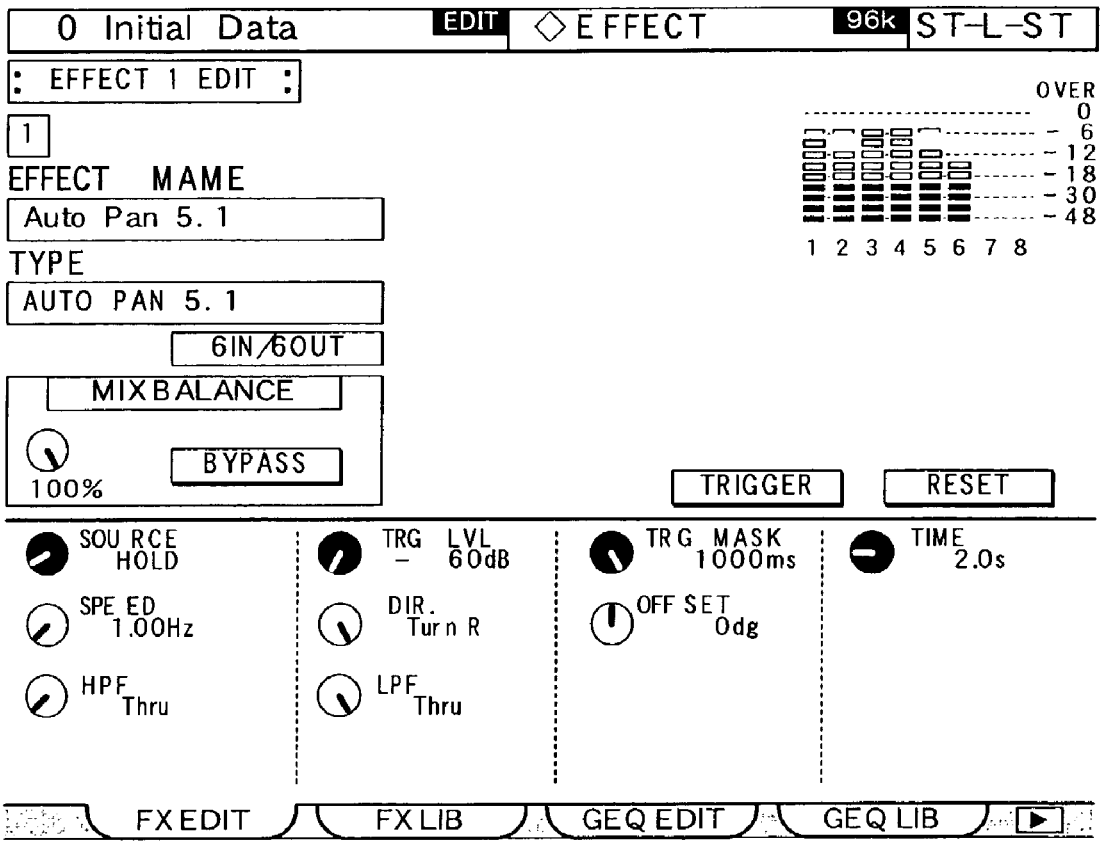
FIG. 3 is a diagram showing an example of a localization control screen displayed in the multi-channel sound image localization control apparatus.

FIG. 3 is a diagram showing an example of the localization control screen visually displayed on a display device 5. On a lower portion of the localization control screen, there are displayed three rows of images of knob-shaped operators (hereinafter also referred to as "screen-displayed operators"). On the other hand, four knob-shaped operators directly operable by the user (hereinafter also referred to as "hardware operators") are provided on a control panel of the multi-channel sound image localization control apparatus 1 as part of the operator unit 4, and respective operational states of the screen-displayed operators on the localization control screen can be changed by manipulating the corresponding hardware operators on the control panel. In the illustrated example of FIG. 3, the four screen-displayed operators in the first row on the localization control screen are highlighted in reverse video indicating that these four operators are currently in a selected state where they can be manipulated by user operation of the four hardware operators. The leftmost screen-displayed operator in the first row is a knob-shaped operator (trigger selection means) operable by the user to select one of a plurality of trigger sources from which to give a trigger for initiating the sound image panning. For this purpose, the leftmost screen-displayed operator is rotatable to a plurality of source-designating positions that include: an OFF position for not automatically varying the panning; HOLD position for causing the panning to always automatically vary even without a panning trigger, an IN1 position for getting a panning trigger from the input IN1; IN2 position for getting a panning trigger from the input IN2; IN3 position for getting a panning trigger from the input IN3; IN4 position for getting a panning trigger from the input IN4; IN5 position for getting a panning trigger from the input IN5; and MIDI position for getting a panning trigger from a MIDI note-on message. Note that the multi-channel sound image localization control apparatus 1 has a MIDI reception port. In the illustrated example of FIG. 3, the "HOLD" position is currently selected as the source-designating position, so as to allow the sound image position to always rotate (i.e., to execute impartment of a rotational panning effect) in response to an LFO signal.

Further, the second screen-displayed operator in the first row is a knob-shaped operator operable by the user to adjust a threshold level (trigger level) when any one of the inputs IN1-IN6 has been selected as the trigger source. Once the input having been selected as the trigger source exceeds the threshold level, the panning trigger is released to initiate the sound image panning. In the illustrated example of FIG. 3, the threshold level is set to "−60 dB". The third screen-displayed operator in the first row is a knob-shaped trigger-masking operator operable to adjust a time period over which any subsequent trigger should be masked after the release of the current trigger; in the illustrated example of FIG. 3, the trigger-masking time period is set to "1000 ms". Furthermore, the fourth (rightmost) screen-displayed operator in the first row is a knob-shaped operator operable to adjust a time period over which the sound image panning should last (i.e., the sound image position should be moved) in response to the release of the panning trigger; in the illustrated example, the sound image panning is set to last for two seconds.

Further, the leftmost screen-displayed operator in the second row is a knob-shaped operator operable by the user to adjust a panning speed (i.e., moving speed of the sound image position); in the illustrated example of FIG. 3, the panning speed is set such that the sound image position rotates once per second. The second screen-displayed operator in the second row is a knob-shaped operator operable to set a panning direction (DIR) in which the sound image position should rotate, i.e. move generally circularly, in a virtual sound field; in the illustrated example, the panning direction is set to clockwise (Turn R). The third screen-displayed operator in the second row is a knob-shaped operator operable to adjust an offset value indicative of a panning start position where the sound image position should start moving upon release of the panning trigger; in the illustrated example, the offset value is set such that the sound image position starts rotating at a "0° (zero degree)" position.

Further, the leftmost screen-displayed operator in the third row is a knob-shaped operator operable by the user to adjust the cutoff frequency of the HPF 12; in the illustrated example of FIG. 3, the HPF 12 is set to an all-pass (through) mode. The second screen-displayed operator in the third row is a knob-shaped operator operable by the user to adjust the cutoff frequency of the LPF 13; in the illustrated example of FIG. 3, the LPF 13 is also set to an all-pass (through) mode.

Figure 4:
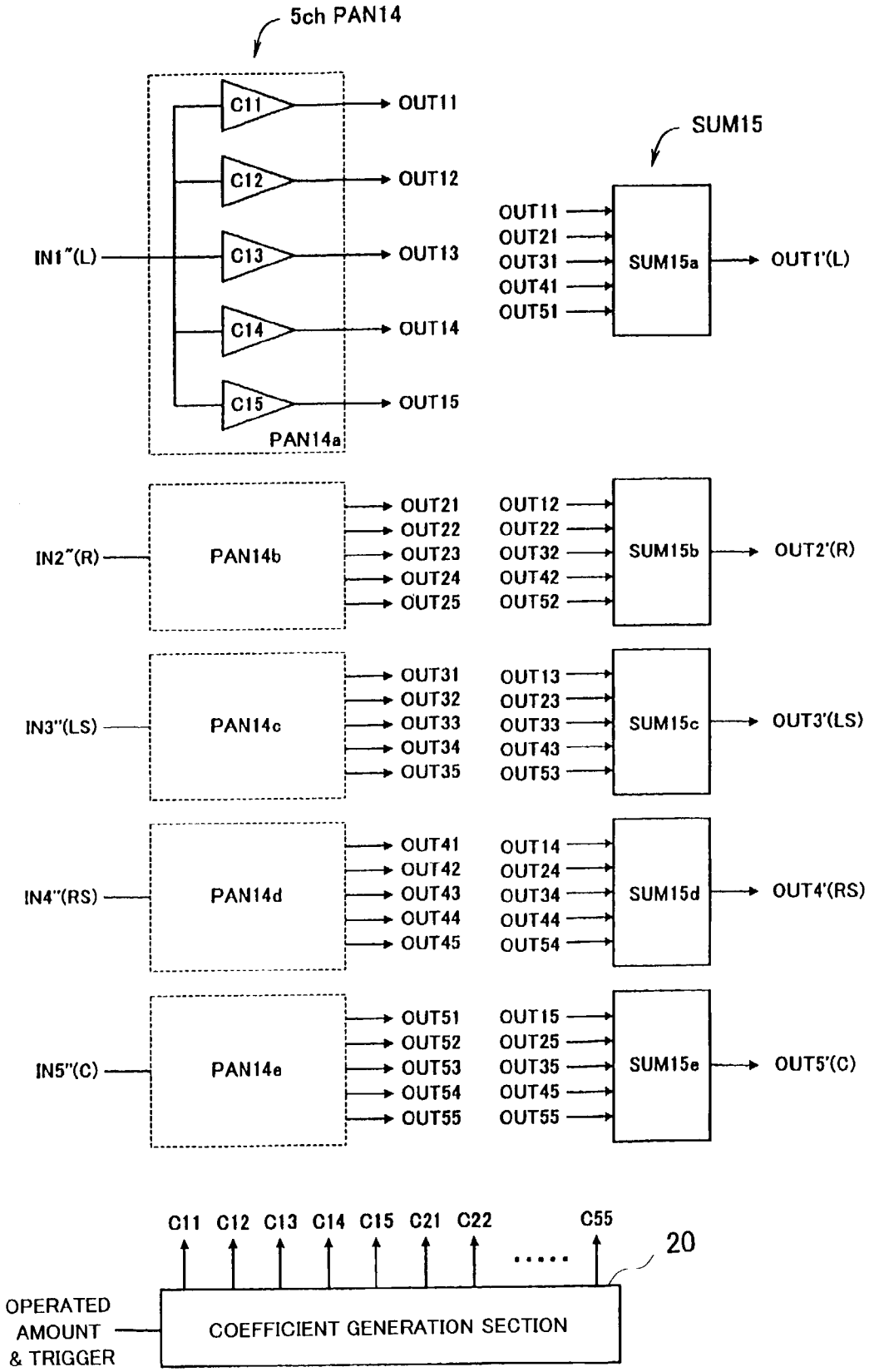
FIG. 4 is a block diagram showing detailed structure of a 5-channel panning control section and synthesis (SUM) section in the multi-channel sound image localization control apparatus of FIG. 2.

FIG. 4 is a block diagram showing an exemplary detailed structure of the 5-channel panning control section 14 and synthesis (SUM) section 15 in the multi-channel sound image localization control apparatus 1 of FIG. 2. In FIG. 4, the panning control elements provided in the 5-channel panning control section 14 in corresponding relation to the five channels are denoted by PAN14*a*, PAN14*b*, PAN14*c*, PAN14*d* and PAN14*e*, respectively. Here, the panning control element PAN14*a* is provided for the L channel and receives the input signal IN"1(L) from the LPF 13, the panning control element PAN14*b* is provided for the R channel and receives the input signal IN"2(R) from the LPF 13, the panning control element PAN14*c* is provided for the LS (left rear) channel and receives the input signal IN"3(LS) from the LPF 13, the panning control element PAN14*d* is provided for the RS (right rear) channel and receives the input signal IN"4(RS) from the LPF 13, and the panning control element PAN14*e* is provided for the center (C) channel and receives the input signal IN"5(C) from the LPF 13. These panning control elements PAN14*a*, PAN14*b*, PAN14*c*, PAN14*d* and PAN14*e* are constructed in a similar manner, and each of the panning control elements includes five coefficient multipliers from which five coefficient-multiplied outputs are produced, as representatively shown at PAN14*a*.

Respective coefficients C11, C12, C13, C14 and C15 are supplied from a coefficient generation section 20 to the five coefficient multipliers of the panning control element PAN14*a*. Similarly, from the coefficient generation section 20, coefficients C21-C25 are supplied to the panning control element PAN14*b*, C31-C35 to the panning control element PAN14*c*, C41-C45 to the panning control element PAN14*d*, and C51-C55 to the panning control element PAN14*e*. The coefficient generation section 20 is supplied with parameters etc. set via the operators shown in FIG. 3, so that it generates the coefficients C11-C55 to be supplied to the panning control elements PAN14*a*, PAN14*b*, PAN14*c*, PAN14*d* and PAN14*e*. Specifically, the coefficient generation section 20 generates the coefficients C11-C55 for rotating (circularly moving) the sound image position of the input multi-channel audio signals, in response to receipt of a panning trigger, while keeping relative relationships among the channels in the original two-dimensional sound image localization of the multi-channel audio signals, and supplies the thus-generated coefficients C11-C55 to the corresponding panning control elements PAN14*a*, PAN14*b*, PAN14*c*, PAN14*d* and PAN14*e*. As will be later described in detail, the coefficients C11-C55 are set as functions of time varying over time.

In FIG. 4, summing elements provided in the synthesis (SUM) section 15 in corresponding relation to the five channels are denoted by SUM15*a*, SUM15*b*, SUM15*c*, SUM15*d* and SUM15*e*, respectively. Here, the summing element SUM15*a*, which is provided for the L channel, sums up respective output signals OUT11, OUT21, OUT31, OUT41 and OUT51 produced, for the L channel, from the panning control elements PAN14*a*, PAN14*b*, PAN14*c*, PAN14*d* and PAN14*e* and provides the resultant sum as an output signal OUT'1(L). The summing element SUM15*b*, which is provided for the R channel, sums up output signals OUT12, OUT22, OUT32, OUT42 and OUT52 produced, for the R channel, from the panning control elements PAN14*a*, PAN14*b*, PAN14*c*, PAN14*d* and PAN14*e* and provides the resultant sum as an output signal OUT'2(R).

Further, the summing element SUM15*c*, which is provided for the LS channel, sums up output signals OUT13, OUT23, OUT33, OUT43 and OUT53 produced, for the LS channel, from the panning control elements PAN14*a*, PAN14*b*, PAN14*c*, PAN14*d* and PAN14*e* and provides the resultant sum as an output signal OUT'3(LS). The summing element SUM15*d*, which is provided for the RS channel, sums up output signals OUT14, OUT24, OUT34, OUT44 and OUT54 produced, for the RS channel, from the panning control elements PAN14*a*, PAN14*b*, PAN14*c*, PAN14*d* and PAN14*e* and provides the resultant sum as an output signal OUT'4 (RS). Furthermore, the summing element SUM15*e*, which is provided for the C channel, sums up output signals OUT15, OUT25, OUT35, OUT45 and OUT55 produced, for the C channel, from the panning control elements PAN14*a*, PAN14*b*, PAN14*c*, PAN14*d* and PAN14*e* and provides the resultant sum as an output signal OUT'5(C).

Figure 6:
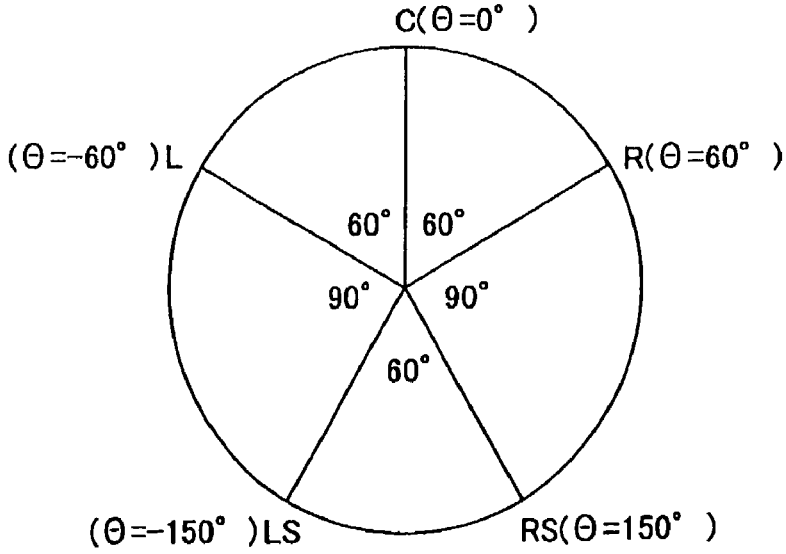
FIG. 6 is a diagram explanatory of sound image localization in the 5.1-channel surround mode.

This and following paragraphs describe the coefficients C11-C55 generated by the coefficient generation section 20. When the multi-channel sound image localization control apparatus 1 is to perform panning control on multi-channel audio inputs of the 5.1-channel surround mode, the coefficients C11-C55 are generated by the coefficient generation section 20 in accordance with the 5.1-channel surround mode. Generally, in the 5.1-channel surround mode, the localization angle Θ of the C channel with respect to a virtual listener is set at 0°, localization angle Θ of the R channel at 60°, localization angle Θ of the RS channel at 150°, localization angle Θ of the L channel at −60°, and localization angle Θ of the LS channel at −150°, as illustrated in FIG. 6. The coefficient generation section 20 generates coefficients C11-C55 corresponding to such localization angles of the five channels, to thereby keep the original two-dimensional sound image localization of the input multi-channel audio signals. Further, the coefficients to be supplied to the panning control elements PAN14*a*, PAN14*b*, PAN14*c*, PAN14*d* and PAN14*e* in relation to a same channel are calculated from a same function. For example, the coefficient C11 to be supplied to the L-channel panning control element PAN14*a* is calculated from a same function by rotating, across −60°, the localization angle Θ on the basis of which the coefficient C51 to be supplied to the C-channel panning control element PAN14*e* is determined.

Namely, in the signal source of the 5.1-channel surround mode, volume levels of audio signals of the individual channels are set on the assumption that the speakers of the individual channels are physically installed in correspondence with the respective localization angles Θ of the channels, so that the sound image is localized at a desired two-dimensional coordinate position within a two-dimensional space surrounded by the speakers. Such sound image localization established in the signal source is referred to as "original two-dimensional sound image localization". In the instant embodiment, the values of the coefficients C11-C55 are set such that the localizations angles Θ of the individual channels are caused to deviate from the above-mentioned original values in accordance with a deviation, from the original sound image localization, of sound image localization to be achieved, with no consideration given to specific two-dimensional coordinate positions within the two-dimensional space surrounded by the speakers.

Figure 5:
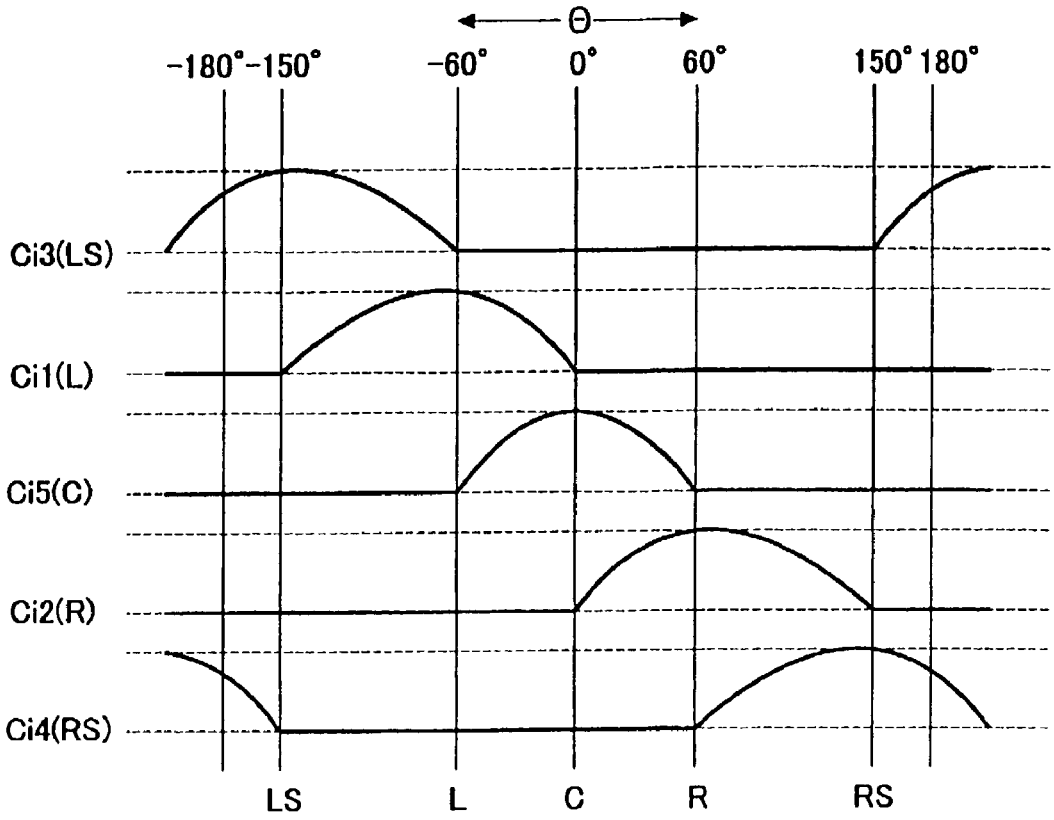
FIG. 5 is a diagram showing examples of functions to be used by the multi-channel sound image localization control apparatus to generate coefficients.

Here, the coefficients C11, C21, C31, C41 and C51 for the L channel are generically represented by coefficients Ci1, the coefficients C12, C22, C32, C42 and C52 for the R channel generically represented by coefficients Ci2, the coefficients C13, C23, C33, C43 and C53 for the LS channel generically represented by coefficients Ci3, the coefficients C14, C24, C34, C44 and C54 for the RS channel generically represented by coefficients Ci4, and the coefficients C15, C25, C35, C45 and C55 for the C channel generically represented by coefficients Ci5. In such a case, respective functions for determining the coefficients Ci3(LS), Ci1(L), Ci5(C), Ci2(R) and Ci4 (RS) to be used for performing panning control on the input multi-channel audio signals while keeping the relative localization states of the multi-channel audio signals localized in two dimensions can be schematically expressed in a manner as shown in FIG. 5. For example, looking at the C-channel coefficients Ci5 summed up by the C-channel summing element SUM15*e* with the localization angle Θ set to 0°, the five coefficients are calculated by substituting the respective localization angles to a function denoted in the center of FIG. 5. Namely, the localization angle to determine the coefficient C55 to be supplied to the C-channel panning control element PAN14*e* is 0°, the localization angle to determine the coefficient C15 to be supplied to the L-channel panning control element PAN14*a* is 300° (−60°), the localization angle to determine the coefficient C25 to be supplied to the panning control element PAN14*b* is 60°, the localization angle to determine the coefficient C35 to be supplied to the panning control element PAN14*c* is 210° (−150°), and the localization angle to determine the coefficient C45 to be supplied to the panning control element PAN14*d* is 150°. Thus, while the coefficient C55 takes a peak value "1", the other coefficients all take a value "0", as clearly seen in FIG. 5.

Looking at the L-channel coefficients Ci1(L) with the localization angle Θ set to 0°, the five coefficients are calculated by substituting the respective localization angles to a function denoted in a second uppermost row of FIG. 5. Namely, the localization angle to determine the coefficient C11 to be supplied to the panning control element PAN14*a* is 300° (−60°), the localization angle to determine the coefficient C21 to be supplied to the panning control element PAN14*b* is 60°, the localization angle to determine the coefficient C31 to be supplied to the panning control element PAN14*c* is 210° (−150°), the localization angle to determine the coefficient C41 to be supplied to the panning control element PAN14*d* is 150°, and the localization angle to determine the coefficient C51 to be supplied to the panning control element PAN14*e* is 0°. Thus, while the coefficient C11 takes the peak value "1", the other coefficients all take the value "0", as clearly seen in FIG. 5. Similarly, looking at the remaining coefficient Ci2-Ci4 with the localization angle Θ set to 0°, the coefficients C22, C33 and C44 take the peak value "1" but the other coefficients all take the value "0".

Namely, when the sound image of the multi-channel audio signals is to be localized at a position where the localization angle Θ is 0° (i.e., where the deviation from the original localization is "0"), only the coefficients C11, C22, C33, C44 and C55 are set to the maximum value "1", while the other coefficients are all set to the value "0". By varying the localization angle Θ to increase over time in a positive (or negative) direction and thereby generating time-varying coefficients C11-C55 corresponding to the varying localization angle Θ, it is possible to impart a clockwise (counterclockwise) rotational panning effect to the input multi-channel audio signals while keeping the original two-dimensional localization.

Now considering the coefficient group C51-C55 to be supplied to the C-channel panning control element PAN14*e*(C) when the multi-channel audio signals are to be localized at a position where the localization angle Θ is in a range of 0°-60°, the coefficients C55 and C52 are set to meaningful values, while the other coefficients are all set to the value "0", as clearly seen in FIG. 5. Specifically, the coefficient C55 is set to a value of cos Θ, and the coefficient C52 is set to a value of sin Θ. Considering the coefficient group C11-C15 to be supplied to the L-channel panning control element PAN14*a*(L), the coefficients C11 and C15 are set to meaningful values, while the other coefficients are all set to the value "0", as clearly seen in FIG. 5. Specifically, the coefficient C11 is set to a value of cos Θ, and the coefficient C15 is set to a value of sin Θ. For each of the other coefficient groups C21-C25, C31-C35 and C41-C45 too, two predetermined coefficients are set to meaningful values and the remaining coefficients are all set to the value "0". Namely, for each of the coefficient groups C11-C15, C21-C25, C31-C35, C41-C45 and C51-C55, only one or two coefficients are set to a meaningful value or values depending on the localization angle Θ; for the coefficient group where two coefficients are set to meaningful values, one of the two coefficients is set to a value of a sine wave while the other coefficient is set to a value of a cosine wave so that a total electric power value (total sound volume) is always the same. Namely, audio signals of two adjoining channels, having meaningful coefficients, are interpolated with the meaningful coefficients, so that a sound image is localized at an intermediate position between the two adjoining channels.

Figure 7:
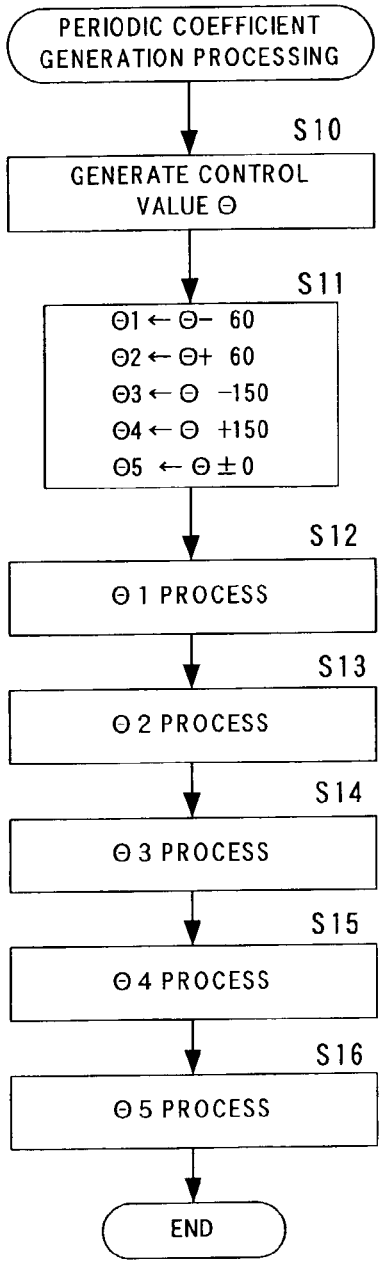
FIG. 7 is a flow chart of periodic coefficient generation processing performed by the multi-channel sound image localization control apparatus to generate coefficients.

Specifically, in the multi-channel sound image localization control apparatus 1 of the present invention, the coefficient generation section 20 generates the above-mentioned coefficients Ci1-Ci5 through periodic coefficient generation processing executed at predetermined time intervals. FIG. 7 is a flow chart of the periodic coefficient generation processing performed by the coefficient generation section 20. Note that coefficients Ci1-Ci5 newly generated by the coefficient generation section 20 are reflected in coefficients Ci1-Ci5 to be output from the generation section 20 upon termination of the periodic coefficient generation processing; that is, during the course of the periodic coefficient generation processing, the coefficients Ci1-Ci5 to be output from the generation section 20 are left unchanged.

The periodic coefficient generation processing is executed every predetermined time, e.g. every few milliseconds or few tens of milliseconds. Each time such predetermined execution timing arrives, the periodic coefficient generation processing is started up, upon which a control value Θ representative of a localization angle to be achieved is generated at step S10. When rotational panning is to be accomplished, the control value Θ is generated by accumulating a predetermined value ΔΘ each time the coefficient generation processing is started. In this case, the control value Θ can be calculated in the following manner:

$$\Theta = \mathrm{MOD}\ \{(\Theta o + \Sigma\Delta\Theta)/360\} \qquad \text{Mathematical Expression (1),}$$

where Θo represents an offset value and the value ΔΘ is determined by a rotating speed and direction of the panned sound image (rotational panning speed and direction) and frequency of the coefficient generation processing. Assuming that the rotational panning speed is 1 Hz, rotational panning direction is clockwise and the value ΔΘ is set to 0°. If a panning trigger is released at a time point indicated by a downward arrow in FIG. 8, the control value Θ will vary in a sawtooth waveform of a 1-sec. period.

After the control value Θ is calculated in the above-mentioned manner, values Θ1-Θ5 are calculated at step S11. The value Θ1 is angle information to be used for calculating the coefficients C11-C15 to be supplied to the L-channel panning control element PAN14*a*; similarly, the values Θ2-Θ5 are information to be used for calculating the coefficients C21-C25, C31-C35, C41-C45 and C51-C55 to be supplied to the panning control elements PAN14*b*-PAN14*e*, respectively. Specifically, (Θ−60) is set as the value Θ1, (Θ+60) is set as the value Θ2, (Θ−150) is set as the value Θ3, (Θ+150) is set as the value Θ4, and the control value Θ itself is set as the value Θ5. Upon completion of the operation at step S11, the periodic coefficient generation processing goes to steps S12-S16, where a Θ1 process-Θ5 process are carried out to calculate the coefficients C11-C15, C21-C25, C31-C35, C41-C45 and C51-C55 to be supplied to the panning control elements PAN14*a*-PAN14*e*, respectively. Once these coefficients C11-C15, C21-C25, C31-C35, C41-C45 and C51-C55 are calculated, the periodic coefficient generation processing is brought to an end.

For convenience of description below, the Θ1 process-Θ5 process executed at steps S12-S16 are generically referred to as Θi processing (i=1, 2, 3, 4 an 5), and the Θi processing is flowcharted in FIG. 9. In this Θi processing, the coefficients Ci1-Ci5 are all set to the value "0" at step S20. At next step S21, an operation is carried out to calculate coefficient values for each range Θi calculated at step S11. If the range Θi is 0-60, the processing branches to step S22, where a calculated result of "cos(π*Θi/120)" is set as the coefficient Ci5 and a calculated result of "sin(π*Θi/120)" is set as the coefficient Ci2; in this case, the coefficients Ci1, Ci3 and Ci4 are not calculated and thus all remain at the value "0". If the range Θi is 60-150, the processing branches to step S23, where a calculated result of "cos(π*(Θi−60)/180)" is set as the coefficient Ci2 and a calculated result of "sin(π*(Θi−60)/180)" is set as the coefficient Ci4; in this case, the coefficients Ci1, Ci3 and Ci5 are not calculated and thus all remain at the value "0".

If the range Θi is 150-210, the processing branches to step S24, where a calculated result of "cos(π*(Θi−150)/120)" is set as the coefficient Ci4 and a calculated result of "sin(π*(Θi−150)/120)" is set as the coefficient Ci3; in this case, the coefficients Ci1, Ci2 and Ci5 are not calculated and thus all remain at the value "0". Furthermore, if the range Θi is 210-300, the processing branches to step S25, where a calculated result of "cos(π*(Θi−210)/180)" is set as the coefficient Ci3 and a calculated result of "sin(π*(Θi−210)/180)" is set as the coefficient Ci1; in this case, the coefficients Ci2, Ci4 and Ci5 are not calculated and thus all remain at the value "0". Furthermore, if the range Θi is 300-360, the processing branches to step S26, where a calculated result of "cos(π*(Θi−360)/120)" is set as the coefficient Ci1 and a calculated result of "sin(π*(Θi−300)/120)" is set as the coefficient Ci5; in this case, the coefficients Ci2, Ci3 and Ci4 are not calculated and thus all remain at the value "0".

Figure 8:
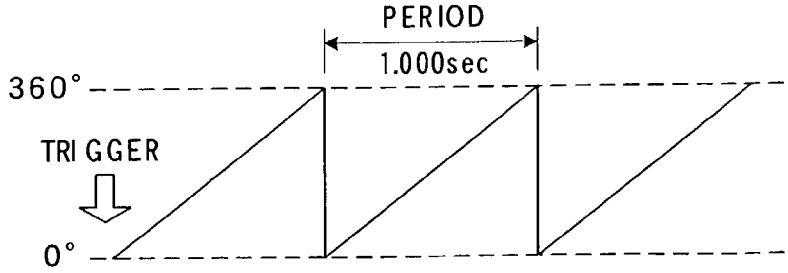
FIG. 8 is a diagram showing variations of a control value generated by the multi-channel sound image localization control apparatus.

When the control value Θ is varying in a sawtooth waveform as illustrated in FIG. 8, the coefficients C11-C55 calculated as above are supplied to the panning control elements PAN14*a*-PAN14*e* and then results of multiplications by these panning control elements PAN14*a*-PAN14*e* are added by the summing elements SUM15*a*-SUM15*e* on the channel-by-channel basis. This way, the instant embodiment can impart the input multi-channel audio signals with a rotational panning effect to allow the sound image position to rotate circularly while keeping the relative two-dimensional localization states of the input audio signals. That is, the deviation from the original sound image localization can be set for rotation within a range of 0-360°. In an alternative, the above-mentioned control value Θ may be generated by the user operating an operator, such as a rotary encoder, in which case it is preferable to set the panning-controlling knob-shaped displayed operator at the OFF position. Also, the rotational panning speed may be varied by changing the inclination of the control value Θ each time a panning trigger is released and thereby allow the control value Θ to vary in a bent-line curve.

Figure 9:
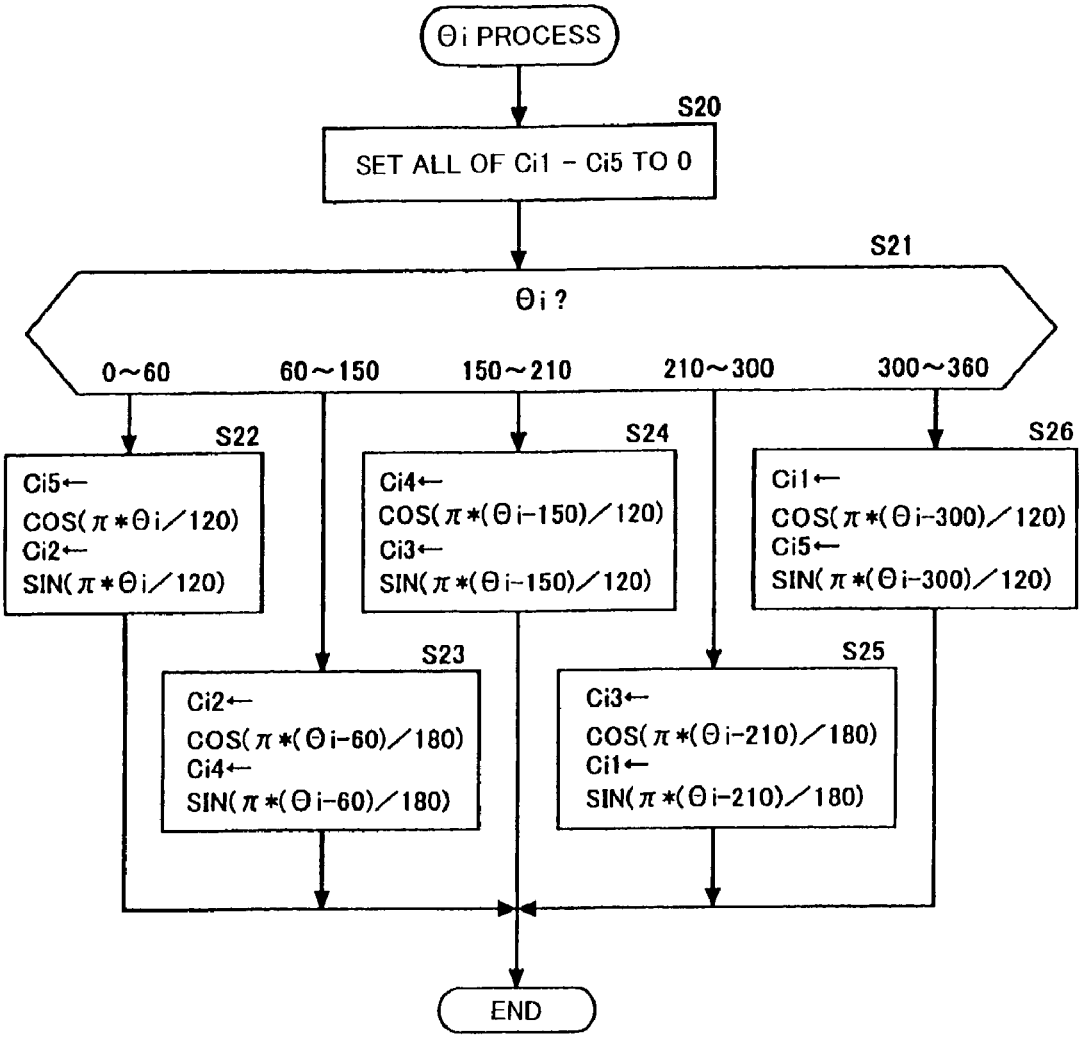
FIG. 9 is a flow chart of a Θ1 process executed during the periodic coefficient generation processing of the multi-channel sound image localization control apparatus.

In the instant embodiment, the coefficient generation section 20 requires an arithmetic operation device or processor because it is constructed to generate the coefficients C11-C55 by performing the periodic coefficient generation processing shown in FIGS. 7 and 9. Thus, FIG. 12 illustrates another example of a coefficient generation section 30 of simplified structure which is designed to generate approximate coefficients C11-C55.

Figures 12, 13:
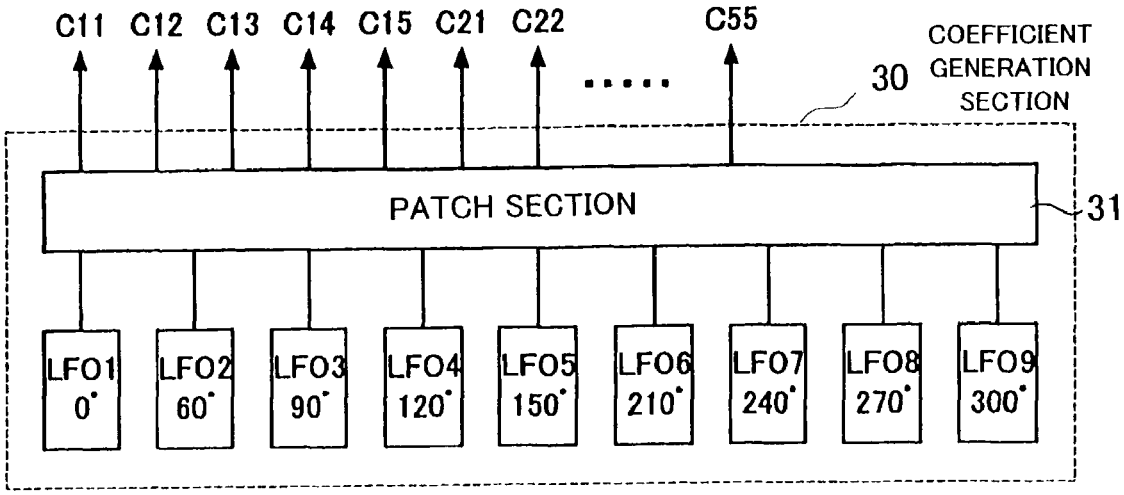
FIG. 12 is a block diagram showing another example structure of a coefficient generation section employed in the multi-channel sound image localization control apparatus.
FIG. 13 is a diagram showing selective patching between inputs and outputs in the coefficient generation section of FIG. 12.

The coefficient generation section 30 of FIG. 12 includes nine low-frequency oscillators LFO1-LFO9, and a patch section 31 for patching outputs of the nine low-frequency oscillators LFO1-LFO9 to the coefficients C11-C55. The nine low-frequency oscillators LFO1-LFO9 generates sine waves differing from one another by a predetermined phase angle. Specifically, the phases of the low-frequency oscillators LFO1, LFO2, LFO3, LFO4, LFO5, LFO6, LFO7, LFO8 and LFO9 are set to 0°, 60°, 90°, 120°, 150°, 210°, 240°, 270° and 300°, respectively. Further, the selective patching, by the patch section 31, between the outputs of the nine low-frequency oscillators LFO1-LFO9 and the coefficients C11-C55 is fixedly set as illustrated in FIG. 13.

Figure 10:
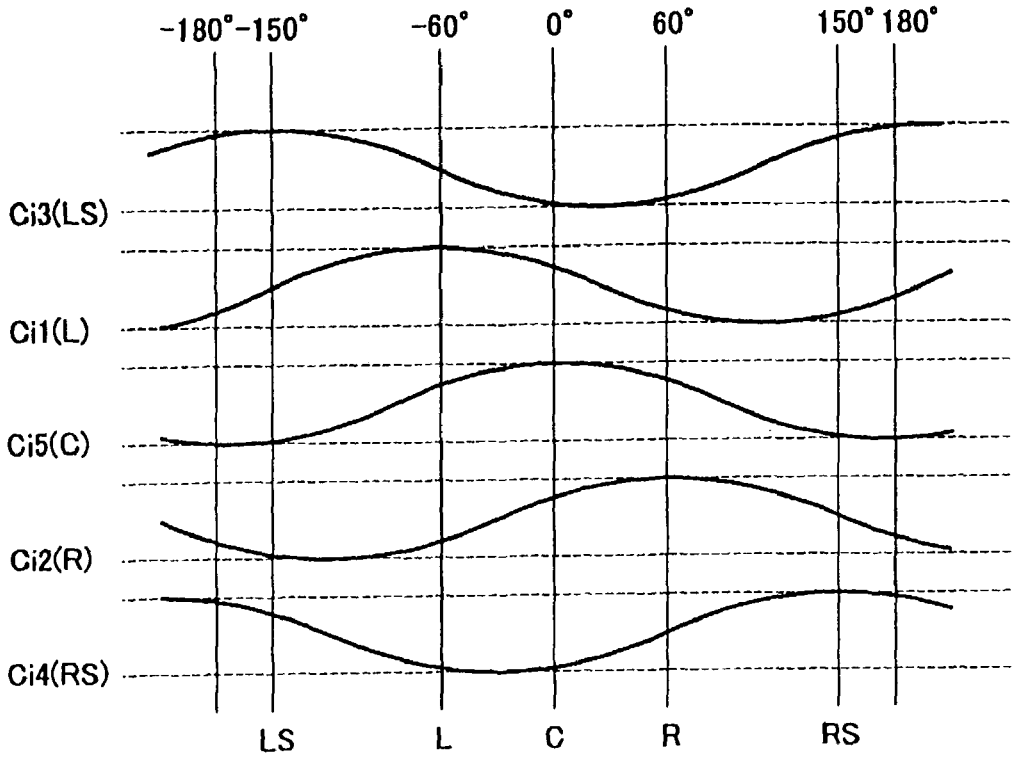
FIG. 10 is a diagram showing other examples of functions to be used by the multi-channel sound image localization control apparatus to generate coefficients.

In FIG. 13, "INPUT" represents multi-channel audio signals respectively input to the panning control elements PAN14*a*-PAN14*e*, and "OUTPUT" represents multi-channel audio signals imparted with a rotational panning effect and respectively output from the summing elements SUM15*a*-SUM15*e*. Namely, the outputs from the low-frequency oscillators LFO1-LFO9 (LFO outputs) patched to individual columns of FIG. 13 are supplied as coefficients to the corresponding panning control elements PAN14*a*-PAN14*e*, and the multi-channel audio signals multiplied by the LFO outputs patched to individual rows as multiplication coefficients are summed by the corresponding summing elements SUM15*a*-SUM15*e*. In this instance, the respective functions to be used to determine the coefficients Ci3(LS), Ci1(L), Ci5(C), Ci2(R) and Ci4(RS) vary in a manner as illustrated in FIG. 10. This way, the coefficient generation section 30 of simplified structure can generate the coefficients C11-C55 that impart the input multi-channel audio signals with a rotational panning effect to allow the sound image position to rotate generally circularly while keeping the relative two-dimensional localization states of the input audio signals.

Figure 11:
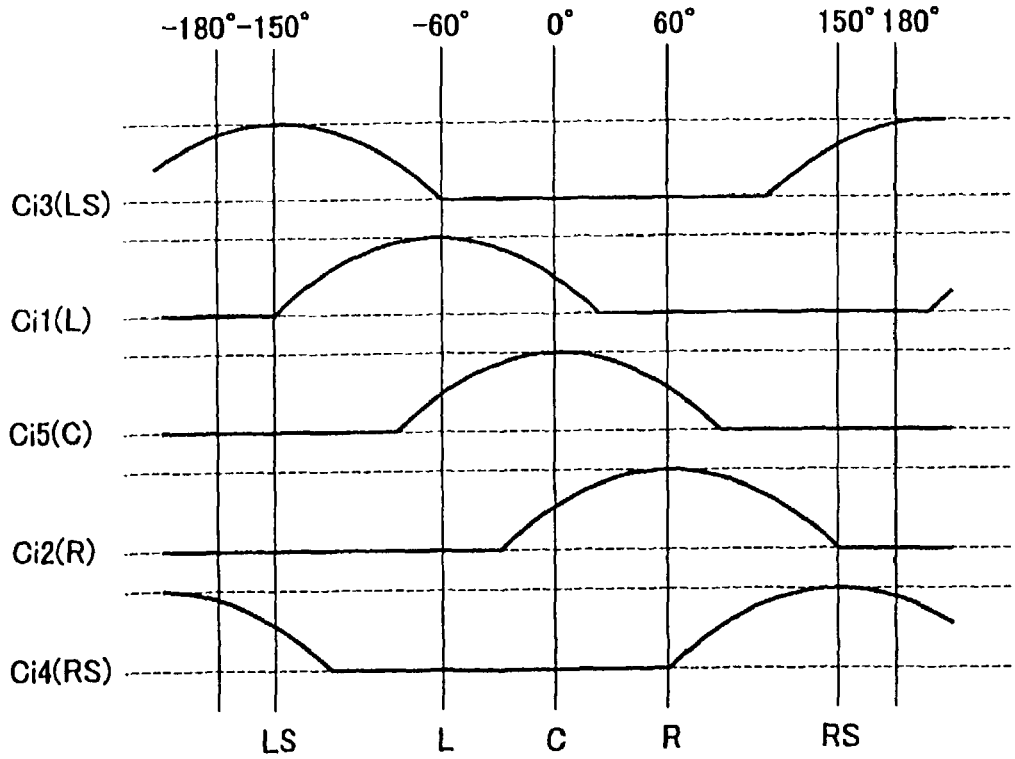
FIG. 11 is a diagram showing still other examples of functions to be used by the multi-channel sound image localization control apparatus to generate coefficients.

Incidentally, because, with the simplified coefficient generation section 30, the coefficients C11-C55 only vary in a sine waveform, the sine waves generated by the low-frequency oscillators LFO1-LFO9 may be subjected to half-wave rectification so as to approximate to the functions of FIG. 5, to thereby provide the functions illustrated in FIG. 11. In this case, the rectification reference and zero value may slightly deviate from each other in a positive/negative direction.

Whereas the foregoing paragraphs have described processing of multi-channel audio signals of the 5.1-channel surround mode, the present invention is also applicable to processing of multi-channel audio signals of the 2×2-channel surround mode, 6.1-channel surround mode, 7.1-channel surround mode, etc., in which case coefficients may be calculated in accordance with the surround mode selected.

Further, although the above-described embodiment is constructed to generate coefficients on the basis of a sine wave, the coefficients may be generated, for example, using an N (N is an arbitrary value greater than one)-order function approximate to a sine wave, rather than the sine wave itself. In another alternative, the coefficients may be generated on the basis of a near sine wave having a waveform envelope defined by bent lines. Further, the functions approximate to a sine wave may be generated by first generating a triangular wave and then subtracting harmonics from the thus-generated triangular wave via a filter. Namely, the terms "sine wave" used in the present invention should be interpreted to embrace such approximate functions as well.

Whereas the described embodiment is constructed to set the panning (sound-image-position moving) speed in terms of frequencies (Hz), the panning speed may alternatively be designated in beats based on a tempo of an automatic performance or automatic accompaniment executed concurrently with the panning control. Further, the function of the coefficients as shown in FIG. 5 may be generated using a function generating table instead of the function calculating means. Furthermore, it should be appreciated that the present invention is applicable to three-dimensional sound image localization control in addition to two-dimensional sound image localization control.

In summary, the present invention is constructed to multiply input multi-channel audio signals by channel coefficients, corresponding to different localization states, to distributively output the coefficient-multiplied signals on the channel-by-channel basis, and then collects and sums up the distributively-output coefficient-multiplied signals on the channel-by-channel basis to thereby generate multi-channel audio signals having been converted into the different localization states. In this way, there is provided an effect imparting apparatus which can change the sound-image-localized position (sound image position) of the input multi-channel audio signals of the 5.1-channel surround mode or other surround mode. In this case, the effect imparting apparatus of the present invention can change the localizing direction of the sound image while keeping relative localization states of the input multi-channel audio signals originally localized in two dimensions. Further, by setting the channel coefficients as a time-varying function, it is possible to achieve a rotational panning effect to allow the sound image to rotate in a two-dimensional plane. Further, by setting the time-varying function to vary in a sine waveform, the present invention can rotate the localization direction while keeping a same sound volume perceivable by the human auditory sense, and by making the time-varying function a sine wave function, it can also rotate the sound image position using an LFO signal as conventionally used in an effecter. Further, by making the sine wave a half-wave-rectified function, it is possible to improve a feeling of sound image localization of the multi-channel audio signals after having been subjected to the rotation of the sound-image localized position, even when the LFO signal is used for the rotation of the sound image position. Furthermore, by generating the channel coefficients in response to user operation of a predetermined operator, the present invention can freely rotate the sound image position of the multi-channel audio signals. Moreover, by varying the channel coefficients at a speed or rate corresponding to given speed data, the present invention can rotate the sound image position of the multi-channel audio signals in accordance with the speed designated by the speed data.

The present invention relates to the subject matter of Japanese Patent Application No. 2002-074150 filed on Mar. 18, 2002, the disclosure of which is expressly incorporated herein by reference in its entirety.

What is claimed is:

1. An effect imparting apparatus which inputs thereto multi-channel audio signals arranged to achieve original two-dimensional sound image localization according to a surround mode and then imparts the multi-channel audio signals with an effect to vary the original two-dimensional sound image localization, wherein the channels of said multi-channel audio signals are configured for playback at speakers that are positioned at uneven angles around a virtual listener placed in a reference position defined by the surround sound mode in accordance with said surround mode of the multi-channel audio signals, said effect imparting apparatus comprising:

an angle control information generation section that generates angle control information designating an angle of deviation from said original two-dimensional sound image localization;

an angle information generation section that generates, on the basis of the angle control information generated by said angle control information generation section and a predetermined localization angle of each of the channels of the multi-channel audio signals according to said surround mode, angle information for each of the channels of the multi-channel audio signals, wherein each predetermined localization angle is based on the angular position with respect to the virtual listener of a speaker associated with a respective channel;

a coefficient generation section that obtains, on the basis of the angle information of each of the channels generated by said angle information generation section, coefficients for individual ones of a plurality of output channels for each of said channels;

a multiplication section that distributes the audio signal of each channel, included in the inputted multi-channel audio signals, to individual ones of said plurality of output channels and multiplies each of the distributed audio signals by corresponding one of said coefficients obtained by said coefficient generation section; and an addition section that is provided in corresponding relation to the output channels and sums up the audio signals, distributed to the individual output channels and multiplied by the corresponding coefficients, separately for each of the output channels, whereby the summed-up audio signals of the output channels are output as multi-channel audio signals having controlled sound image localization with the original two-dimensional sound image localization displaced through the angle designated by the angle control information.

2. An effect imparting apparatus as claimed in claim 1 wherein the angle control information dynamically varies with passage of time, in response to which the coefficients to be multiplied with the distributed audio signals are variably set in accordance with the dynamically-varying angle control information that causes the original two-dimensional sound image localization to rotatably vary in two-dimensions.

3. An effect imparting apparatus as claimed in claim 1 wherein the angle control information dynamically varies with passage of time, in response to which the coefficients are each given as a function of time, and the original two-dimensional sound image localization varies over time in two dimensions in response to variation over time of the coefficients.

4. An effect imparting apparatus as claimed in claim 3 wherein the coefficients are generated on the basis of a periodic function.

5. An effect imparting apparatus as claimed in claim 3 wherein the coefficients are generated on the basis of a function of a half-wave rectified waveform of a sine wave.

6. An effect imparting apparatus as claimed in claim 1 wherein each of the channels of the inputted multi-channel audio signals corresponds to a predetermined virtual localization direction, and wherein, on the basis of a sine wave function characteristic that, when the sine wave function characteristic indicates a peak value for the localization direction corresponding to a given first channel, indicates a zero value for the localization direction corresponding to a given second channel adjoining said first channel, the coefficients corresponding to said first channel and second channel are set to meaningful values, while the coefficient corresponding to a third channel is set to a meaningless value such that a zero value is indicated for the localization direction corresponding to the third channel.

7. An effect imparting apparatus as claimed in claim 1 wherein said angle control information generation section generates the angle control information in response to operation of an operator control.

8. An effect imparting apparatus as claimed in claim 1 which further comprises a speed data generation section that generates speed data indicative of a variation speed, wherein said angle control information generation section generates the angle control information varying at a variation speed corresponding to the speed data generated by said speed data generation section.

9. An effect imparting apparatus as claimed in claim 1 wherein said angle control information generation section generates the angle control information that varies over time and which further comprises:

a trigger selection section that selectively controls a trigger to initiate variation over time of the angle control information.

10. An effect imparting apparatus as claimed in claim 9 which further comprises:

a control section that, when the variation over time of the angle control information is triggered, inhibits a subsequent trigger for a given trigger masking time; and a setting section that variably sets the trigger masking time.

11. An effect imparting apparatus as claimed in claim 9 which further comprises a setting section that variably sets a triggering threshold level when said trigger selection section has chosen to set, as a trigger signal, any one of the inputted multi-channel audio signals.

12. An effect imparting apparatus as claimed in claim 1 wherein said angle control information generation section generates the angle control information that varies over time for a given variation time following a triggering time point when timewise variation of the angle control information is instructed, and which further comprises a setting section that variably sets the given variation time.

13. An effect imparting apparatus as claimed in claim 1 wherein said angle control information generation section generates the angle control information that varies over time; and which further comprises a setting section that variably sets a speed at which the angle control information is to be varied over time.

14. An effect imparting apparatus as claimed in claim 1 wherein said angle control information generation section generates the angle control information that varies over time so as to cause the original two-dimensional sound image localization defined by the multi-channel audio signals input to said effect imparting apparatus to rotatably vary in two dimensions; and includes a setting section that variably sets a rotating direction of the sound image localization.

15. An effect imparting apparatus as claimed in claim 1 wherein said angle control information generation section generates the angle control information that varies over time so as to cause the original two-dimensional sound image localization defined by the multi-channel audio signals input to said effect imparting apparatus to rotatably vary in two dimensions; and includes a setting section that variably sets an offset value indicative of a localization start position where variation over time of the angle control information is to be initiated.

16. An effect imparting apparatus as claimed in claim 1 which further comprises:

a filter section that filters the inputted multi-channel audio signals in a stage preceding said multiplication section; and an adjustment section that variably adjusts a characteristic of said filter section.

17. An effect imparting apparatus as claimed in claim 1 wherein the inputted multi-channel audio signals include audio signals of a plurality of channels arranged to achieve the original two-dimensional sound image localization defined by the multi-channel audio signals input to said effect imparting apparatus, and an audio signal of a given channel that has no relation to sound image localization, and wherein the audio signal of the given channel is output directly from said effect imparting apparatus without being input to said multiplication section.

18. An effect imparting apparatus as claimed in claim 1 wherein said multi-channel audio signals comprise audio signals of five channels.

19. An effect imparting apparatus as claimed in claim 18 wherein said surround mode of said multi-channel audio signals is a 5.1-channel surround mode.

20. An effect imparting apparatus as claimed in claim 18 wherein said angle information generation section calculates, on the basis of the angle control information generated by said angle control information generation section and said predetermined localization angle according to said surround mode, an angle for each of said five channels of the multi-channel audio signals, and wherein said coefficient generation section generates, on the basis of data of the angle of each of the channels calculated by said angle information generation section and in accordance with a function specific to each of the output channels, said coefficients for individual ones of said plurality of output channels for said each of said five channels.

21. An effect imparting apparatus as claimed in claim 1 wherein said coefficient generation section generates, on the basis of data of the angle information of each of the channels calculated by said angle information generation section and in accordance with a function specific to each of the output channels, said coefficients for individual ones of said plurality of output channels for each of said channels wherein the function specific to each of the output channels is different from that of the other output channels.

22. An effect imparting apparatus as claimed in claim 1 which further comprises a plurality of speakers each corresponding to any one of the output channels, said plurality of speakers being allocated unevenly around a position where said virtual listener is to be located.

23. An effect imparting apparatus which receives multi-channel audio signals input thereto and controls sound image localization of the multi-channel audio signals, the channels of said multi-channel audio signals being configured for playback at speakers that are positioned at uneven angles around a virtual listener placed in a reference position defined by a surround sound mode in accordance with the surround mode of the multi-channel audio signals, said effect imparting apparatus comprising:

an angle control information generation section that generates angle control information designating an angle of deviation from said original two-dimensional sound image localization;

an angle information generation section that generates, on the basis of the angle control information generated by said angle control information generation section and a predetermined localization angle of each of the channels of the multi-channel audio signals according to said surround mode, angle information for each of the channels of the multi-channel audio signals, wherein each predetermined localization angle is based on the angular position with respect to the virtual listener of a speaker associated with a respective channel;

a coefficient generation section that obtains, on the basis of the angle information of each of the channels generated by said angle information generation section, sound-image localizing coefficients for individual ones of a plurality of output channels for each of said channels;

a multiplication section that distributes the audio signal of each channel, included in input multi-channel audio signals, to individual ones of said plurality of sound-image localizing channels and multiplies each of the distributed audio signals by corresponding one of said coefficients obtained by said coefficient generation section; and an addition section that is provided in corresponding relation to the sound-image localizing channels and sums up the audio signals, distributed to the individual sound-image localizing channels and multiplied by the corresponding coefficients, separately for each of the sound-image localizing channels, the summed-up audio signals of the individual sound-image localizing channels being outputted as multi-channel audio signals having controlled sound image localization with the original two-dimensional sound image localization displaced through the angle designated by the angle control information, wherein said coefficient generation section generates the sound-image localizing coefficients using governing functions for respective localized positions of the plurality of sound-image localizing channels.

24. An effect imparting apparatus as claimed in claim 23 wherein said angle control information generation section generates the angle control information that varies over time, and which further comprises a trigger selection section that selects a trigger condition to initiate timewise variation of the angle control information.

25. An effect imparting apparatus as claimed in claim 24 which further comprises a setting section that variably sets a triggering threshold level when said trigger selection section has chosen to use any one of the input multi-channel audio signals as a trigger signal, the trigger condition being activated when the trigger signal exceeds the triggering threshold level.

26. An effect imparting apparatus as claimed in claim 24 which further comprises:

a control section that, when the timewise variation of the angle control information is triggered, inhibits a subsequent trigger for a given trigger-masking time; and a setting section that variably sets the trigger-masking time.

27. An effect imparting apparatus as claimed in claim 23 wherein said angle control information generation section generates the angle control information that varies over time for a given variation time following a triggering time point when timewise variation of the angle control information is instructed, and which further comprises a setting section that variably sets the given variation time.

28. An effect imparting apparatus as claimed in claim 23 wherein said angle control information generation section generates the angle control information that varies over time, and which further comprises a setting section that variably sets a speed at which the angle control information is to be varied over time.

29. An effect imparting apparatus as claimed in claim 23 wherein said angle control information generation section generates the angle control information that varies over time so as to cause the original two-dimensional sound image localization to rotatably vary in two dimensions, and which further comprises a setting section that variably sets a rotating direction of the sound image localization.

30. An effect imparting apparatus as claimed in claim 23 wherein said angle control information generation section generates the angle control information that varies over time so as to cause the original two-dimensional sound image localization to rotatably vary in two dimensions, and which further comprises a setting section that variably sets an offset value indicative of a localization start position at which timewise variation of the coefficients is to be initiated.

31. An effect imparting apparatus as claimed in claim 23 which further comprises:

a filter section that filters the inputted multi-channel audio signals in a stage preceding said multiplication section; and an adjustment section that variably adjusts a characteristic of said filter section.

32. An effect imparting apparatus as claimed in claim 23 which inputs, together with the multi-channel audio signals, an audio signal of a low frequency effect channel that has no relation to sound image localization, and wherein the audio signal of the low frequency effect channel is output directly from said effect imparting apparatus without being input to said multiplication section.

33. An effect imparting apparatus as claimed in claim 23 wherein said multi-channel audio signals comprise audio signals of five channels.

34. An effect imparting apparatus as claimed in claim 33 wherein said surround mode of said multi-channel audio signals is a 5.1-channel surround mode.

35. An effect imparting apparatus as claimed in claim 33 wherein said angle information generation section calculates, on the basis of the angle control information generated by said angle control information generation section and said predetermined localization angle according to said surround mode, an angle for each of said five channels of the multi-channel audio signals, and wherein said coefficient generation section generates, on the basis of data of the angle of each of the channels calculated by said angle information generation section and in accordance with a function specific to each of the output channels, said coefficients for individual ones of said plurality of output channels for each of said five channels.

36. An effect imparting apparatus as claimed in claim 23 wherein said coefficient generation section generates, on the basis of data of the angle information of each of the channels calculated by said angle information generation section and in accordance with a function specific to each of the output channels, said coefficients for individual ones of said plurality of output channels for said each of the channels wherein the function specific to each of the output channels is different from that of the other output channels.

* * * * *